US007705803B2

(12) United States Patent
Kwon

(10) Patent No.: US 7,705,803 B2
(45) Date of Patent: Apr. 27, 2010

(54) DRIVING APPARATUS FOR PLASMA DISPLAY PANEL AND IMAGE PROCESSING METHOD THEREOF

(75) Inventor: Tae-Kyong Kwon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 1199 days.

(21) Appl. No.: 11/131,953

(22) Filed: May 18, 2005

(65) Prior Publication Data

US 2005/0275605 A1 Dec. 15, 2005

(30) Foreign Application Priority Data

Jun. 15, 2004 (KR) ..... 10-2004-0043984

(51) Int. Cl.
*G09G 3/28* (2006.01)

(52) U.S. Cl. ..... 345/60; 345/55; 345/30

(58) Field of Classification Search ..... 345/60–63, 345/30, 55

See application file for complete search history.

(56) References Cited

U.S. PATENT DOCUMENTS 6,680,732 B2 * 1/2004 Yoo ..... 345/173
2001/0006378 A1 * 7/2001 Kasahara et al. ..... 345/60
2005/0104813 A1 * 5/2005 Lee ..... 345/63

FOREIGN PATENT DOCUMENTS

KR 2002-0014766 2/2002

OTHER PUBLICATIONS

Korean Intellectual Property Office Korean Patent Abstracts for Publication No. 1020020014766 A, date of publication of Feb. 25, 2002, in the name of G. Iwamoto.

* cited by examiner

*Primary Examiner*—Amare Mengistu
*Assistant Examiner*—Insa Sadio
(74) *Attorney, Agent, or Firm*—Christie, Parker & Hale, LLP

(57) ABSTRACT

A plasma display panel displaying grayscales by a combination of brightness weights of a plurality of subfields in a frame. A peak subfield index of a current frame is generated based on a highest grayscale value detected from an input image data of the current frame, wherein the peak subfield index contains information of at least one subfield that is not used in the current frame. At least one period of reset, address, and sustain periods of the at least one subfield that is not used in the current frame is removed in response to a control signal and the peak subfield index of the current frame. The control signal is generated based on a comparison of a peak subfield index of a previous frame that has been delayed by one frame and the peak subfield index of the current frame.

13 Claims, 9 Drawing Sheets

DRIVING APPARATUS FOR PLASMA DISPLAY PANEL AND IMAGE PROCESSING METHOD THEREOF

CROSS-REFERENCE TO RELATED APPLICATION

This application claims priority to and the benefit of Korean Patent Application No. 10-2004-0043984 filed on Jun. 15, 2004 in the Korean Intellectual Property Office, the entire content of which is incorporated herein by reference.

BACKGROUND OF THE INVENTION

1. Field of the Invention

The present invention relates to a driving apparatus for a plasma display panel and an image processing method thereof, and in particular, to a driving apparatus for plasma display panel and an image processing method thereof that results in reduced power consumption without flickers.

2. Description of the Related Art

Recently, flat panel displays, such as a liquid crystal display (LCD), a field emission display (FED), and a plasma display panel (PDP) have been actively developed. The PDP is advantageous over other flat panel displays in regard to its high luminance, high luminous efficiency, and wide viewing angle.

A PDP displays an image by activating phosphor by ultraviolet (UV) rays generated by a discharge of an inert gas, e.g., He+Ne, He+Xe, or He+Ne+Xe. Such a PDP is classified into a direct current (DC) type or an alternating current (AC) type according to patterns of waveforms of driving voltages applied thereto and discharge cell structures thereof.

The DC PDP displays an image by applying a predetermined driving waveform to electrodes exposed to a discharge space. Since a DC PDP allows a direct current to flow through the discharge space while a voltage is applied to the exposed electrodes, such a DC PDP problematically requires a resistance for limiting the current. On the other hand, the AC PDP has electrodes covered with a dielectric layer that forms a capacitor to limit the current and protects the electrodes from the impact of ions during discharge. Accordingly, an AC PDP typically has a longer lifetime than a DC PDP.

FIG. 1 is a partial perspective view of an AC PDP.

As shown in FIG. 1, a conventional AC PDP includes scan and sustain electrodes 4 and 5 formed on an upper substrate 1 and address electrodes 8 formed on a lower substrate 6. Each of the scan and sustain electrodes 4 and 5 includes a transparent electrode and a metal bus electrode. The metal bus electrode has narrower width than the transparent electrode, and is disposed at a side of the transparent electrode.

The transparent electrode is usually formed of indium-tin-oxide (ITO). The metal bus electrode is usually formed of metal such as chrome Cr, and is formed on the transparent electrode so as to reduce a voltage drop by the transparent electrode having high resistance.

An upper dielectric layer 2 and a protective layer 3 are formed on the upper substrate 1 having the scan and sustain electrodes 4 and 5 formed thereon. Wall charges generated by a plasma discharge are accumulated on the upper dielectric layer 2. The protective layer 3 protects the upper dielectric layer 2 from damages caused by sputtering during the plasma discharge, and enhances emission efficiency of secondary electrons.

A lower dielectric layer 7 and barrier ribs 9 are formed on the lower substrate 6 on which the address electrodes 8 are formed, and a phosphor layer 10 is formed on the lower dielectric layer 7 and a surface of the barrier ribs 9. The address electrodes 8 are formed in a direction crossing the scan and sustain electrodes 4 and 5. The barrier ribs 9 are formed linearly or in a lattice pattern (not shown), and prevents UV rays and visible light generated by a discharge from leaking into adjacent discharge cells. The phosphor layer 10 is excited by the UV rays generated by a plasma discharge, and produces red, green, or blue color. An inert gas mixture is contained in a discharge space 11 formed by the upper substrate 1, the lower substrate 6, and the barrier ribs 9. A discharge cell (which may also be referred to as a cell) 12 is formed at an intersection region of the address electrode 8 and a pair of one scan electrode 4 and one sustain electrode 5 that are disposed in parallel.

FIG. 2 illustrates an electrode arrangement of a PDP.

Referring to FIG. 2, address electrodes $A_1$ to $A_m$ are disposed in a column direction. Scan electrodes $Y_1$ to $Y_n$ and sustain electrodes $X_1$ to $X_n$ are disposed in a row direction in pairs. Discharge cells are formed in an m×n matrix format, wherein a discharge cell 12 is formed at each area where one of the address electrodes $A_1$-$A_m$ crosses a pair of the scan and sustain electrodes $Y_1$-$Y_n$ and $X_1$-$X_n$.

The PDP is driven by frames, where each frame is divided into a plurality of subfields having different numbers of light emitting periods in order to realize a time-division grayscale display. Each subfield includes a reset period for initializing every discharge cell, an address period for selecting turn-on cells (i.e., cells to be turned on), and a sustain period for realizing grayscales according to the number of discharges in the turn-on cells.

That is, as shown in FIG. 3, each of a plurality of subfields includes a reset period, an address period, and a sustain period. FIG. 3 illustrates an exemplary subfield arrangement wherein one frame includes eight subfields so as to realize 256 grayscales. The reset period and the address period of the subfields are of the same length independent of the subfields. However, the sustain periods increase in ratios of $2^n$ (n=0,1, 2,3,4,5,6,7) according to subfields, so as to realize grayscales.

For example, in order to realize a grayscale of level 3 at a specific discharge cell, the specific cell is discharged during first and second subfields SF1 and SF2. In addition, in order to realize a grayscale of level 127 at a specific discharge cell, the specific cell is discharged during first through seventh subfields SF1-SF7. That is, 256 grayscales of an image are realized in a PDP by a combination of subfields having different light emitting periods.

According to such a conventional PDP, subfields that do not contribute to grayscales are also driven by the reset period, the address period, and the sustain period, and accordingly, power consumption becomes problematically wasteful. For a detailed example, the grayscale of the level 3 is realized by the first and second subfields SF1 and SF2. That is, for the grayscale of the level 3, the third to eighth subfields SF3-SF8 do not contribute to the grayscale. However, in this case, the reset, address, and sustain periods are also performed in the third to eighth subfields SF3-SF8 that do not contribute to the grayscale, and accordingly unnecessary switching operations are performed, thereby causing wasteful power consumption.

The information disclosed in this Background of the Invention section is only for enhancement of understanding of the background of the invention, and therefore, unless explicitly described to the contrary, it should not be taken as an acknowledgement or any form of suggestion that this information forms the prior art that is already known in this country to a person of ordinary skill in the art.

SUMMARY OF THE INVENTION

An aspect of the present invention is to provide a driving apparatus for plasma display panel and an image processing method thereof that results in reduced power consumption without flickers.

In an exemplary embodiment according to the present invention, a method for processing an image of a plasma display panel is provided. The plasma display panel displays grayscales by a combination of brightness weights of a plurality of subfields in a frame displayed on the plasma display panel in response to an input video signal. According to such an exemplary method, a peak subfield index of a current frame is generated based on a highest grayscale value detected from an image data of the current frame, the peak subfield index having information of at least one subfield that is not used in the current frame. A control signal is generated based on a comparison between a peak subfield index of a previous frame and the peak subfield index of the current frame. At least one period of reset, address, and sustain periods of the at least one subfield that is not used in the current frame is removed in response to the control signal and the peak subfield index of the current frame.

In another exemplary embodiment according to the present invention, an apparatus for driving a plasma display panel is provided. The apparatus includes a peak detector, a delay unit, a comparator, a subfield generator and a sustain number generator. The peak detector generates a peak subfield index of a current frame based on a highest grayscale value detected from an image data of the current frame, the peak subfield index having information of at least one subfield that is not used in the current frame. The delay unit delays a peak subfield index of a previous frame by a period of one frame. The comparator generates at least one control signal based on a comparison between the peak subfield index of the previous frame supplied from the delay unit and the peak subfield index of the current frame supplied from the peak detector. The subfield generator and a sustain number generator remove at least one period of reset, address, and sustain periods of the at least one subfield that is not used in the current frame, in response to the control signal and the peak subfield index of the current frame.

DETAILED DESCRIPTION

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

Hereinafter, a plasma display panel (PDP) and an image processing method thereof according to exemplary embodiments of the present invention is described in detail with reference to the drawings.

Figure 1:
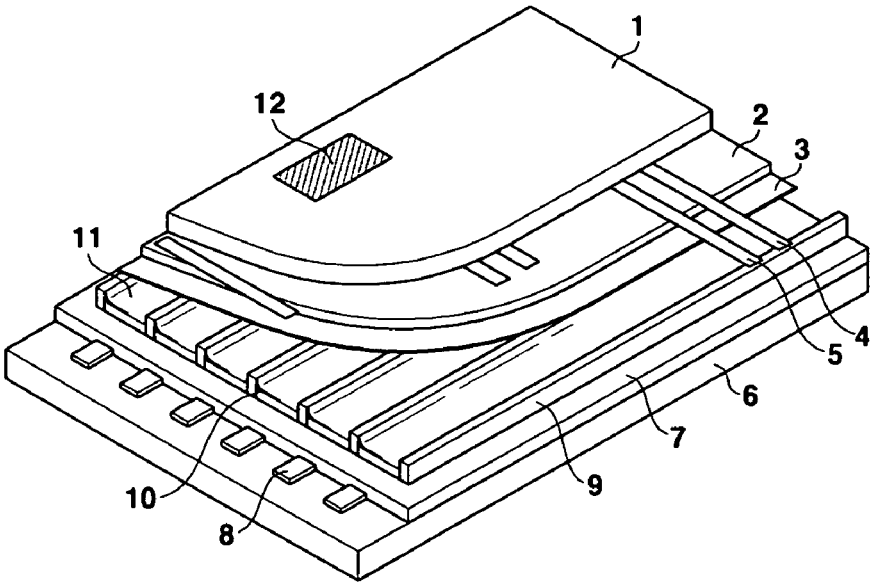
FIG. 1 is a partial perspective view of an AC PDP.
Figure 2:
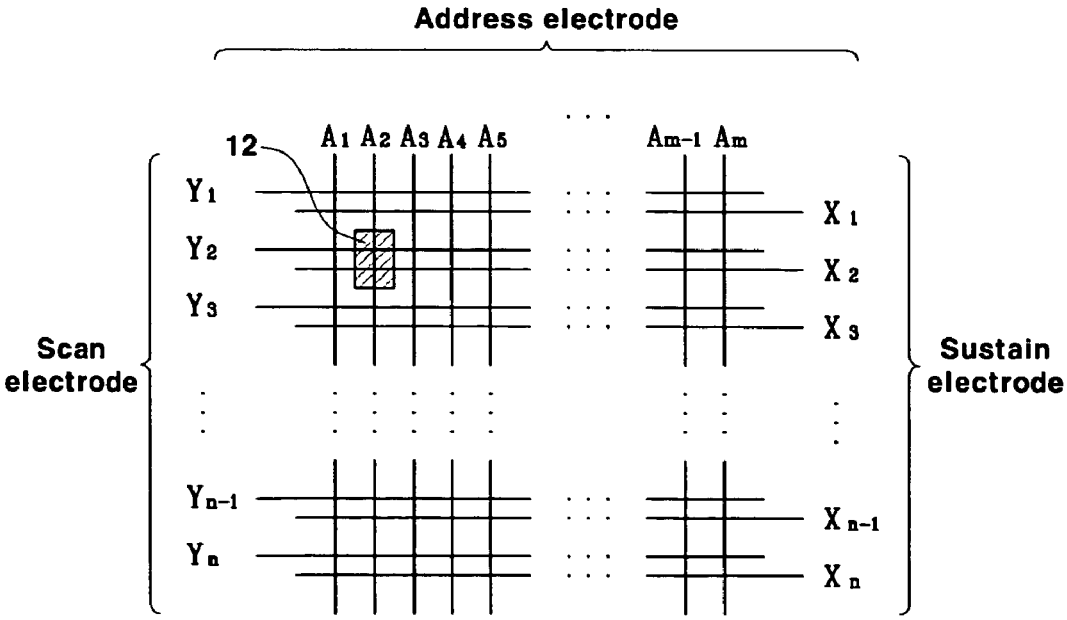
FIG. 2 illustrates an electrode arrangement of a PDP.
Figure 3:
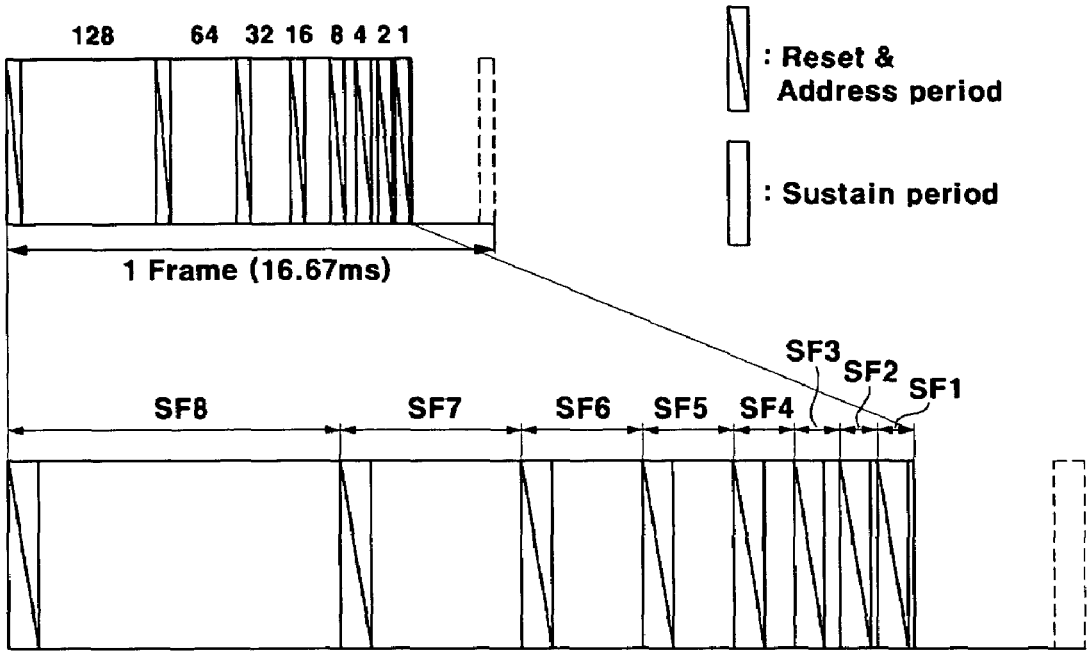
FIG. 3 shows a method for displaying grayscales in a PDP.
Figure 4:
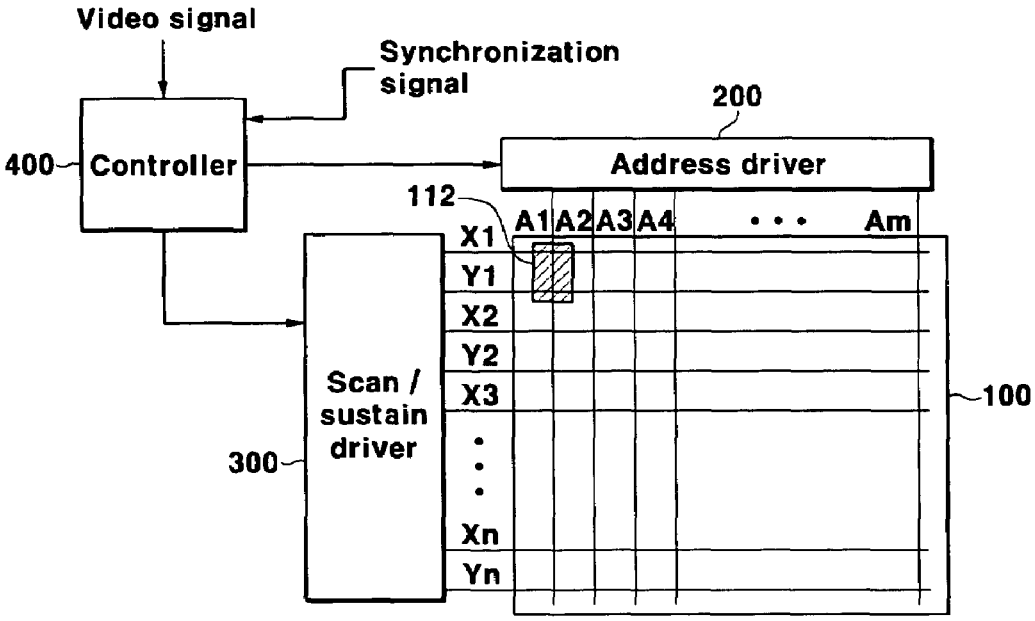
FIG. 4 is a schematic plan view of a PDP according to exemplary embodiments of the present invention.

FIG. 4 is a schematic top plan view of a PDP according to an exemplary embodiment of the present invention.

Referring to FIG. 4, the PDP according to the exemplary embodiment of the present invention includes a panel 100, an address driver 200, a scan/sustain driver 300, and a controller 400.

The panel 100 includes a plurality of scan and sustain electrodes $Y_1$-$Y_n$ and $X_1$-$X_n$ arranged in pairs and a plurality of address electrodes $A_1$-$A_m$ each being formed in a direction crossing the scan and sustain electrodes $Y_1$-$Y_n$ and $X_1$-$X_n$.

A plurality of discharge cells 112 formed at intersections between the address electrodes and the scan and sustain electrodes are driven by the address driver 200 and the scan/sustain driver 300. In more detail, the address driver 200 provides data signals for selecting the discharge cells 112 to respective address electrodes $A_1$-$A_m$ under the control of the controller 400. The scan/sustain driver 300 generates sustain discharges in the discharge cells 112 selected in the address period, by alternately supplying a sustain voltage to the scan electrodes $Y_1$-$Y_n$ and the sustain electrodes $X_1$-$X_n$ under the control of the controller 400.

The controller 400 controls the address driver 200 and the scan/sustain driver 300 in response to an externally provided video signal and a synchronization signal.

Figure 5:
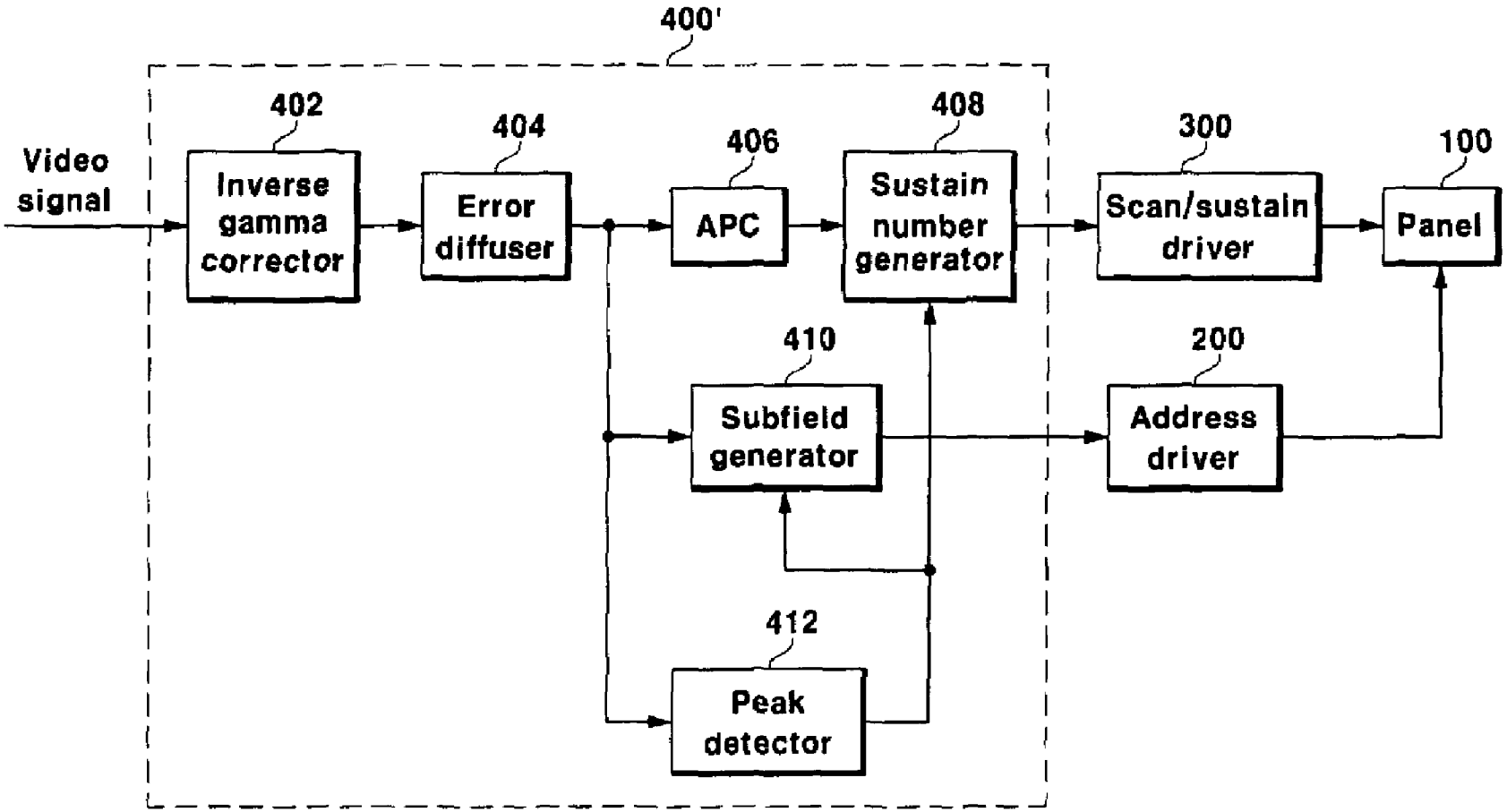
FIG. 5 illustrates a block diagram of a controller shown in FIG. 4 according to a first exemplary embodiment of the present invention.

For such an operation, as shown in FIG. 5, a controller 400' includes an inverse gamma corrector 402, an error diffuser 404, an automatic power controller (APC) 406, a sustain number generator 408, a subfield generator 410, and a peak detector 412. The controller 400' according to a first exemplary embodiment of the present invention, for example, can be used as the controller 400 of FIG. 4. Handling of the synchronization signal is not illustrated in FIG. 5 as it is not essential to a complete understanding of the present invention.

The inverse gamma corrector 402 performs an inverse gamma correction of an externally input video signal (i.e., image data). In more detail, the inverse gamma corrector 402 changes a grayscale of the externally input video signal using a lookup table (not shown) having data corresponding to an inverse gamma curve.

The error diffuser 404 enhances grayscale representation by diffusing lower bits of the corrected image data to adjacent pixels. More detailed description of such an error diffuser 404 may be found in Korean Patent Publication No. 10-2002-0014766.

The APC 406 detects a load ratio of the image data output from the error diffuser 404, and calculates an APC level corresponding to the detected load ratio. The APC 406 limits a power consumption of the PDP below a predetermined level, by varying the number of sustain pulses depending on the load ratio of the image data. In more detail, since each driving circuit used in a PDP has a threshold power consumption below which reliability is ensured in driving the PDP, the APC 406 prevents the power consumption from rising above the threshold power consumption by decreasing the number of sustain pulses in the case of high load ratio.

The sustain number generator 408 controls the number of sustain pulses corresponding to the APC level input from the APC 406 and the number of subfields to be included in one frame in response to a peak subfield index (i.e., an index of a highest grayscale subfield) supplied from the peak detector 412. The scan/sustain driver 300 supplies sustain pulses in a number designated by the sustain number generator 408, and supplies a driving waveform only in subfields determined by the sustain number generator 408. The controlling of the number of subfields to be included in one frame by the sustain number generator 408 will be described in more detail later in a description of the peak detector 412.

The subfield generator 410 generates subfield data using the image data output from the error diffuser 404. In addition, the subfield generator 410 controls the number of subfields to be included in one frame corresponding to the peak subfield index output from the peak detector 412. The address driver 200 supplies the driving waveform only in the subfields determined by the subfield generator 410. Controlling the number of subfields to be included in one frame by the subfield generator 410 will be described in more detail later in a description of the peak detector 412.

The peak detector 412 detects image data having a highest grayscale among currently input image data of one frame, and detects the highest grayscale subfield (and accordingly, the peak subfield index) used in the image data. The peak subfield index is higher as a frame has less number of subfields that are not used in the frame. For example, when the image data has a highest grayscale of a level 127 in the frame, the peak detector 412 detects a seventh subfield SF7 in a frame shown in FIG. 6A, as its highest grayscale subfield. That is, the peak detector 412 detects a highest grayscale subfield (and accordingly, the peak subfield index) used in a frame using image data having highest grayscale value in the image data of the frame.

In this case, the peak detector 412 detects the peak subfield index after delaying the image data supplied from the error diffuser 404 by one frame. The delaying of the image data by one frame is already known to a person of ordinary skill in the art, and will not be described in further detail.

The peak subfield index detected by the peak detector 412 is supplied to the subfield generator 410 and the sustain number generator 408. The subfield generator 410 supplied with the peak subfield index removes subfields having higher grayscales than the peak subfield. For example, when the peak subfield is the seventh subfield SF7, the subfield generator 410 removes the eighth subfield SF8 as shown in FIG. 6B. Then the address driver 200 does not perform unnecessary switching operations (i.e., switching operations that do not contribute to realization of the required grayscale) during the address period of the eighth subfield SF8, and accordingly, reduction of power consumption may be achieved.

The sustain number generator 408 supplied with the peak subfield index removes subfields having higher grayscales than the peak subfield. For example, when the peak subfield is the seventh subfield SF7, the sustain number generator 408 removes the eighth subfield SF8. Then, the scan/sustain driver 300 does not perform unnecessary switching operations during the reset and sustain periods of the eighth subfield SF8, and accordingly, reduction of power consumption may be achieved.

That is, according to the first exemplary embodiment of the present invention shown in FIG. 5, the power consumption of a PDP is reduced by removing subfields that need not be used in a frame. However, flickers may be caused in such a PDP.

Figure 6A:
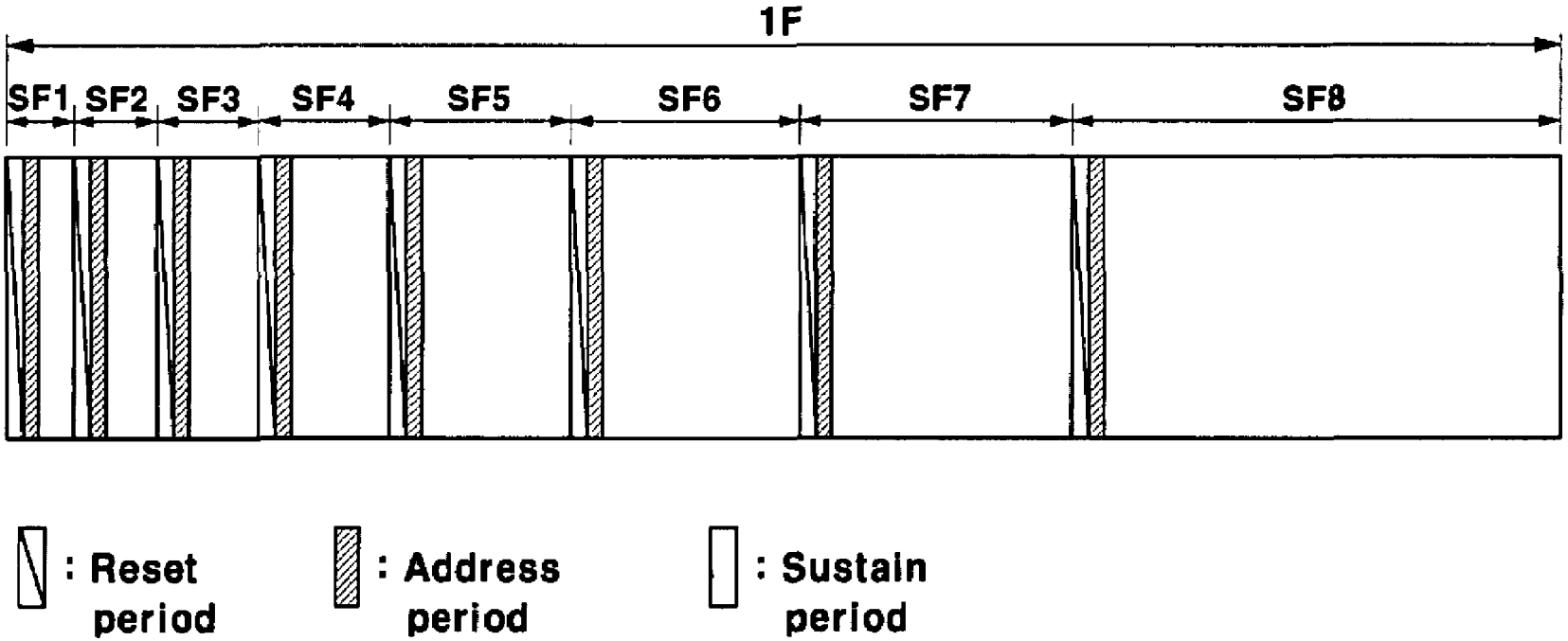
FIG. 6A and FIG. 6B respectively illustrate an exemplary subfield arrangement of one frame determined by the controller shown in FIG. 5.
Figure 6B:
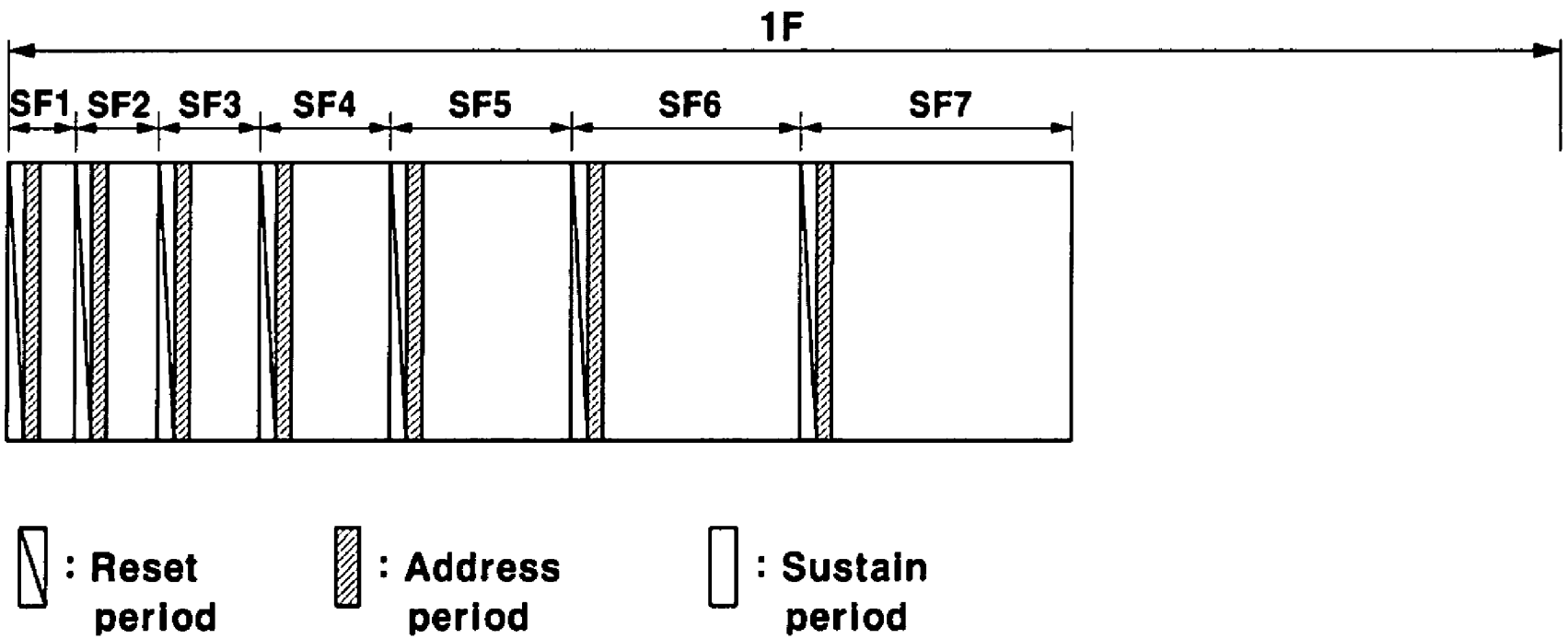

In more detail, when the eighth subfield SF8 is a highest grayscale subfield (i.e., a peak subfield) in an i-th frame (here, i is an odd number) and the seventh subfield SF7 is a highest grayscale subfield in a (i+1)th frame, the panel 100 displays an image by repeatedly realizing the frames shown in FIG. 6A and FIG. 6B. Then, flickers may problematically be caused in the panel 100, by repeated display of frames of high and low grayscales. Another embodiment of the present invention as shown in FIG. 7 has been made to address such a problem.

Figure 7:
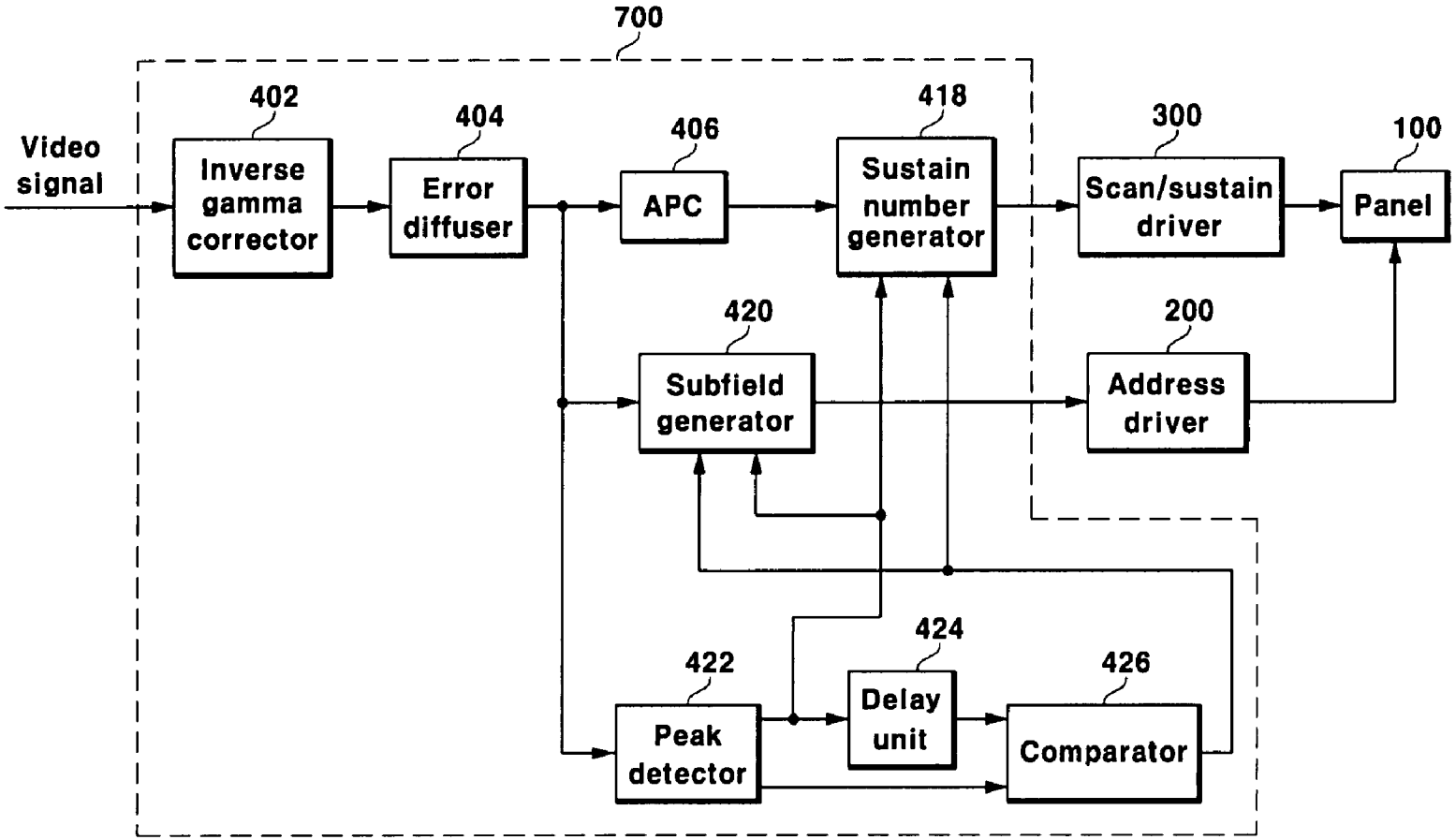
FIG. 7 illustrates a block diagram of a controller shown in FIG. 4 according to a second exemplary embodiment of the present invention.

In FIG. 7, blocks having the same function as the blocks in FIG. 5 are designated by the same reference numerals as in FIG. 5.

Referring to FIG. 7, a PDP according to a second exemplary embodiment of the present invention includes a panel 100, an address driver 200, a scan/sustain driver 300, and a controller 700. The controller 700, for example, may be used as the controller 400 of FIG. 4.

The scan/sustain driver 300 and the address driver 200 supply, under the control of the controller 700, a driving waveform so as to display a desired image on the panel 100.

The controller 700 controls the address driver 200 and the scan/sustain driver 300 in response to an externally provided video signal and a synchronization signal, so as to realize the desired image on the panel 100. Handling of the synchronization signal is not illustrated in FIG. 7 as it is not essential to a complete understanding of the present invention.

For the control operation, as shown in FIG. 7, the controller 700 includes an inverse gamma corrector 402, an error diffuser 404, an APC 406, a sustain number generator 418, a subfield generator 420, a peak detector 422, a delay unit 424, and a comparator 426.

The inverse gamma corrector 402 performs an inverse gamma correction of an externally input video signal (i.e., image data). The error diffuser 404 enhances grayscale representation by diffusing lower bits of the corrected image data to adjacent pixels. The APC 406 detects a load ratio of the image data output from the error diffuser 404, and calculates an APC level corresponding to the detected load ratio.

The sustain number generator 418 determines the number of sustain pulses corresponding to the APC level input from the APC 406. In addition, the sustain number generator 418 controls the reset, address, and sustain periods of subfields in a frame in accordance with a peak subfield index supplied from the peak detector 422 and a control signal supplied from the comparator 426. The controlling of the reset, address, and sustain periods by the sustain number generator 418 will be later described in more detail.

The subfield generator 420 generates subfield data using the image data output from the error diffuser 404. In addition, the subfield generator 420 controls the reset, address, and sustain periods of subfields in a frame in accordance with a peak subfield index supplied from the peak detector 422 and a control signal supplied from the comparator 426. The controlling of the reset, address, and sustain periods by the subfield generator 420 will be later described in more detail.

The peak detector 422 detects an image datum having a highest grayscale among currently input image data of one frame, and detects a highest grayscale subfield (and accordingly, a peak subfield index) used in the image data. The peak subfield index is higher as a frame has less number of subfields that are not used in the frame. For example, when the image data has the highest grayscale of a level 127 in the frame, the peak detector 422 detects a seventh subfield SF7 in a frame shown in FIG. 6A, as its highest grayscale subfield. That is, the peak detector 422 detects the highest grayscale subfield (and accordingly, the peak subfield index) used in a frame using image data having the highest grayscale value in the image data of the frame. The peak subfield index detected by the peak detector 422 is supplied to the delay unit 424, the comparator 426, the subfield generator 420, and the sustain number generator 418.

The delay unit 424 supplies the peak subfield index detected by the peak detector 422 to the comparator 426, after delaying by one frame.

The comparator 426 compares the peak subfield index of k-th frame (here, k is an integer) supplied from the peak detector 422 and the peak subfield index of (k−1)th frame supplied from the delay unit 424, and outputs a control signal corresponding to the comparison result to the sustain number generator 418 and the subfield generator 420. In more detail, when the peak subfield index of the k-th frame is greater than or equal to the peak subfield index of the (k−1)th frame, the comparator 426 outputs a first control signal (e.g., a value of 1). Otherwise, the comparator 426 outputs a second control signal (e.g., a value of 0).

In response to an input of the first control signal from the comparator 426, the subfield generator 420 controls subfields in accordance with the peak subfield index supplied from the peak detector 422. That is, upon receiving the first control signal, the subfield generator 420 removes subfields having higher grayscales than the peak subfield. For example, when the peak subfield is the seventh subfield SF7 while the first control signal is input, the subfield generator 420 removes the eighth subfield SF8 as shown in FIG. 6B. Then, the address driver 200 does not perform unnecessary switching operations (i.e., switching operations that do not contribute to realization of the required grayscale) during the address period of the eighth subfield SF8, and accordingly, reduction of power consumption may be achieved.

In response to an input of the first control signal from the comparator 426, the sustain number generator 418 controls subfields in accordance with the peak subfield index supplied from the peak detector 422. That is, upon receiving the first control signal, the sustain number generator 418 removes subfields having higher grayscales than the peak subfield. For example, when the peak subfield is the seventh subfield SF7 while the first control signal is input, the sustain number generator 418 removes the eighth subfield SF8 as shown in FIG. 6B. Then, the scan/sustain driver 300 does not perform unnecessary switching operations during the reset and sustain periods of the eighth subfield SF8, and accordingly, reduction of power consumption may be achieved.

On the other hand, in response to the second control signal, the subfield generator 420 and the sustain number generator 418 respectively remove subfields having higher grayscales than the peak subfield except for a reset period of a subfield having a grayscale higher than but closest to the peak subfield. For example, when a peak subfield of a previous frame is the eighth subfield and that of a current frame lies in the seventh subfield, the subfield generator 420 and the sustain number generator 418 remove address and sustain periods of the eighth subfield SF8 except for a reset period thereof (refer to FIG. 8). Then, unnecessary switching operations are not performed by the scan/sustain driver 300 and the address driver 200 during the address and sustain periods of the eighth subfield SF8, and accordingly, reduction of power consumption may be achieved.

Figure 8:
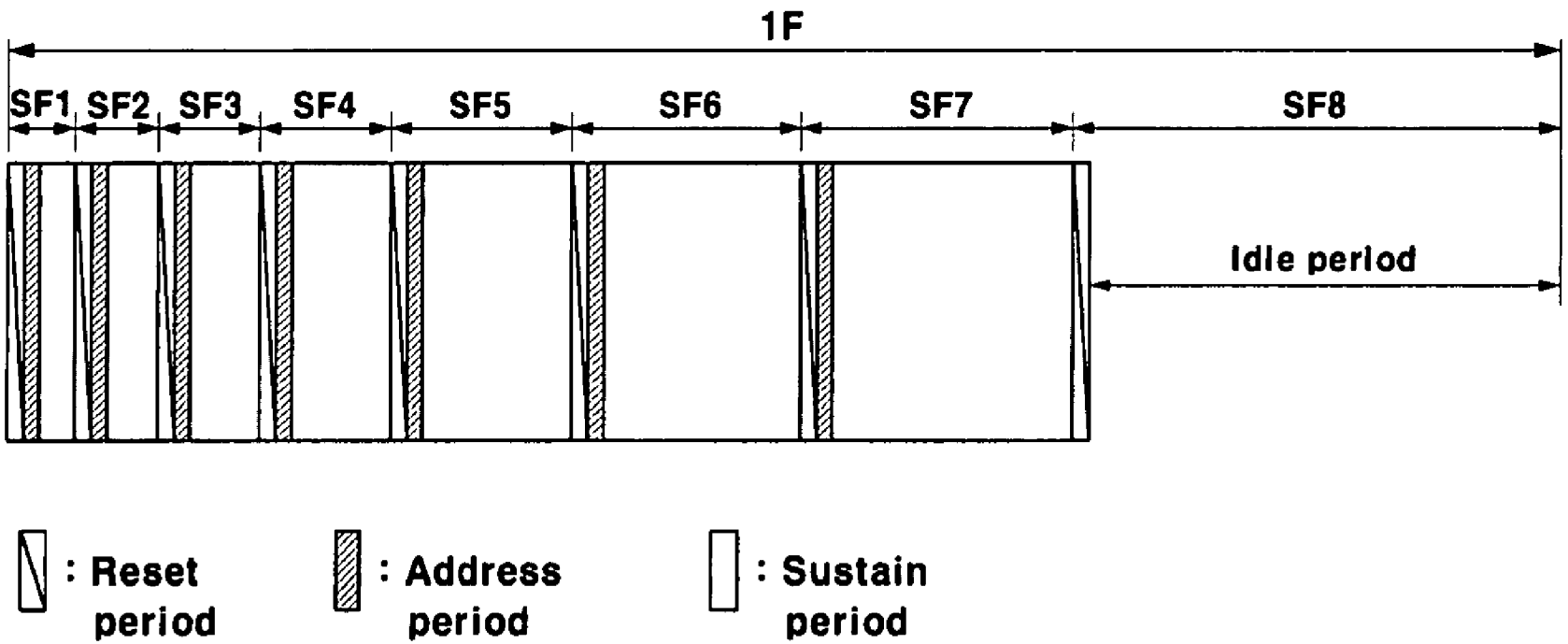
FIG. 8 illustrates an exemplary subfield arrangement of one frame determined by the controller shown in FIG. 7.

Further, flickers may be prevented from occurring on the panel 100 by maintaining the reset period in the subfield having a grayscale higher than but closest to the peak subfield when the second control signal is input. For example, such a mechanism of preventing flickers is hereinafter described in connection with the case where the eighth subfield SF8 is the highest grayscale subfield (i.e., a peak subfield) in an i-th frame (here, i is an odd number) and the seventh subfield SF7 is the highest grayscale subfield in a (i+1)th frame. First, in the i-th frame, the grayscale is realized using the first through eighth subfields as shown in FIG. 6A. Then in the (i+1)th frame, the grayscale is realized using the first through seventh subfields as shown in FIG. 8, and in addition, the eighth subfield includes a reset period. When the eighth subfield includes a reset period, a luminance difference between frames shown in FIG. 6A and FIG. 8 is reduced, and accordingly, flickers of the panel 100 may be prevented.

That is, according to the second exemplary embodiment of the present invention, when a grayscale is changed from a frame of a high peak subfield index to a frame of a low peak subfield index, flickers may be prevented by maintaining a reset period in a subfield having a grayscale higher than but closest to the low peak subfield is maintained. In addition, when frames of a same peak subfield index are repeatedly displayed, all subfields having higher grayscale than the peak subfield (in this case, including a reset period in a subfield having a grayscale higher than but closest to the peak subfield) are removed, and thus, additional power consumption may be prevented.

Figure 9:
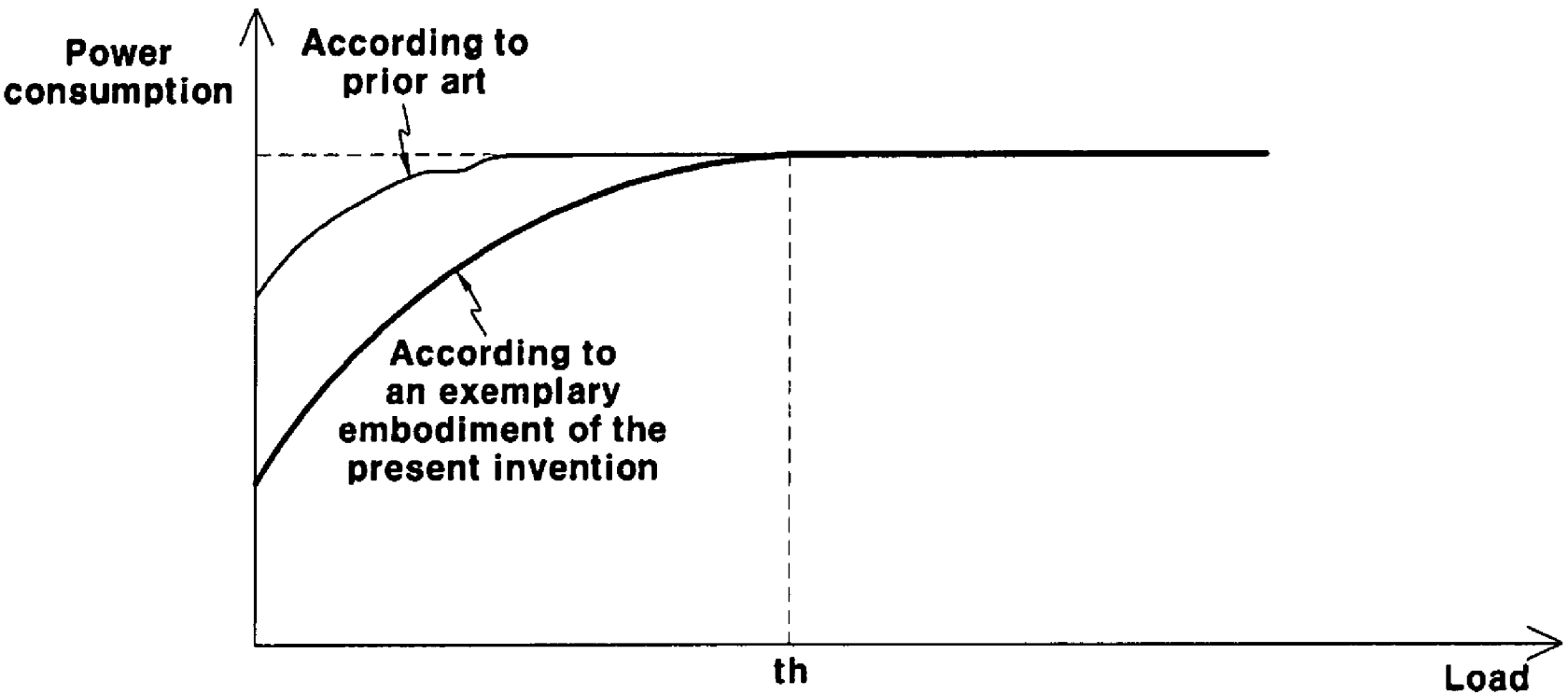
FIG. 9 illustrates graphs showing power consumptions, respectively, of prior art PDP and a panel applied with an exemplary embodiment of the present invention.

FIG. 9 illustrates graphs that compare a power consumption of a conventional PDP to a power consumption of PDPs shown in FIG. 5 and FIG. 7 according to exemplary embodiments of the present invention.

Figure 10:
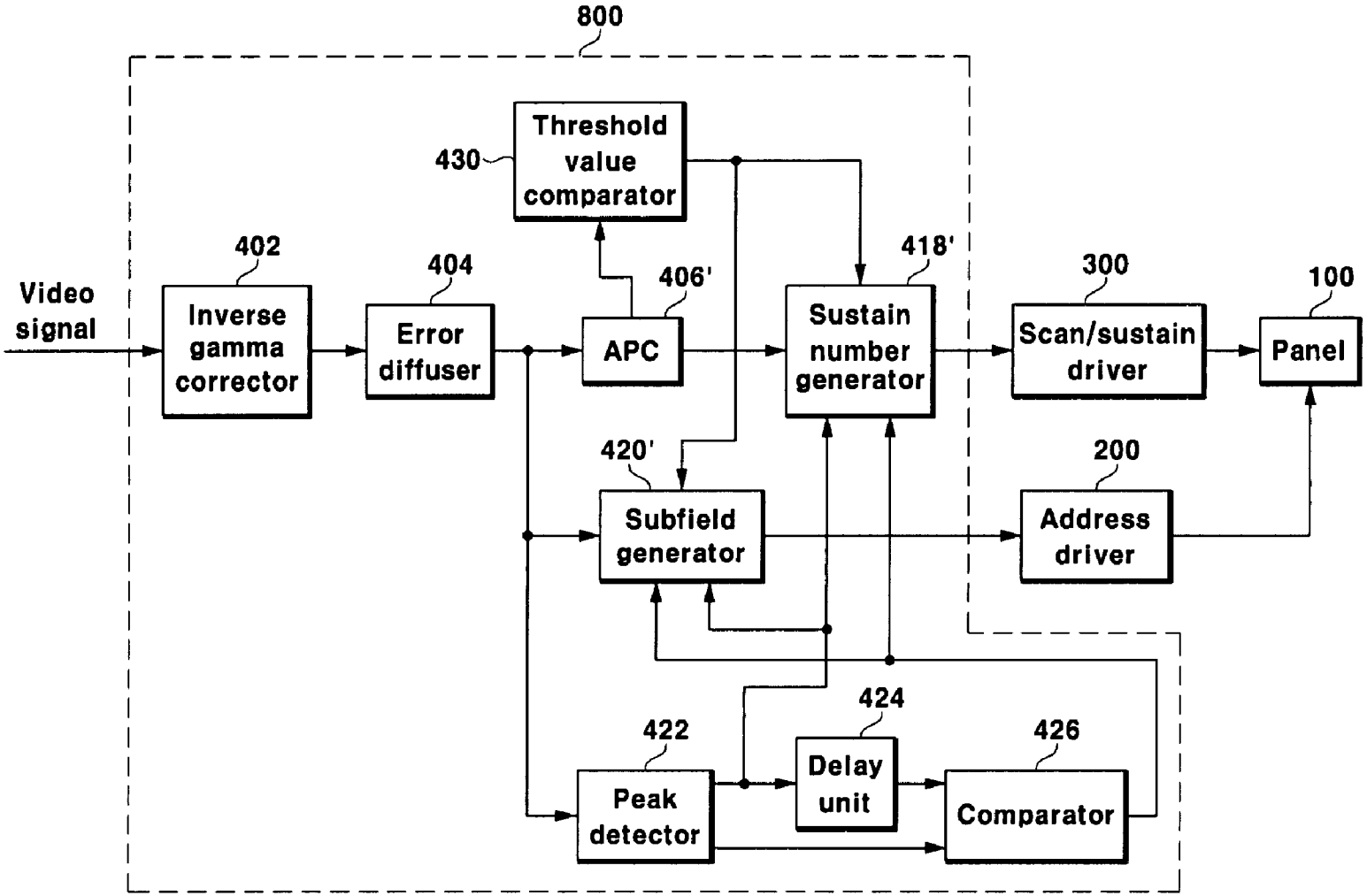
FIG. 10 is a block diagram of a controller shown in FIG. 4 according to a third exemplary embodiment of the present invention.

Referring to FIG. 9, a PDP applied with an exemplary embodiment of the present invention shows a lower power consumption than a conventional PDP. On the other hand, when a load of a PDP exceeds a threshold value th such that a power consumption reaches a threshold power consumption, a conventional PDP and a PDP according to an exemplary embodiment of the present invention have the same power consumption by a function of the APC. It is notable that, flickers caused by repeating of frames shown in FIG. 6A and FIG. 6B occur only when the load is less than or equal to the threshold value th and not when the load exceeds the threshold value th. Therefore, as shown in FIG. 10, a controller 800 according to a third exemplary embodiment of the present invention includes a threshold value comparator 430 in addition to the same and/or similar components as the controller 700 shown in FIG. 7. The controller 800, for example, may be used as the controller 400 of FIG. 4.

Referring to FIG. 10, the threshold value comparator 430 stores the threshold value th of the load at which a PDP shows the threshold power consumption. The stored threshold value th is experimentally determined since it may change according to a resolution and/or size of the panel 100.

The threshold value comparator 430 compares the load detected by an APC 406' and the threshold value stored therein, and then supplies a control signal corresponding to the comparison result to a subfield generator 420' and the sustain number generator 418'. For example, when the load detected by the APC 406' is below the threshold value (in this case, flickers may be caused), the threshold value comparator 430 supplies a third control signal to the subfield generator 420' and the sustain number generator 418'.

Similar to the controller 700 described in reference to FIG. 7, the subfield generator 420' and the sustain number generator 418' receiving the third control signal are operated in accordance with the control signal of the comparator 426. That is, when the third control signal is input from the threshold value comparator 430, the grayscale is realized in accordance with the first control signal and the second control signal supplied from the comparator 426.

When the load detected by the APC 406' exceeds the threshold value (in this case, flickers are not caused), the threshold value comparator 430 supplies a fourth control signal to the subfield generator 420' and the sustain number generator 418'. The subfield generator 420' and the sustain number generator 418' supplied with the fourth control signal remove subfields having higher grayscales than the peak subfield, regardless of the comparison result of the comparator 426. That is, when the fourth control signal is input from the threshold value comparator 430, flickers are not expected in this case. Therefore, the subfield generator 420' and the sustain number generator 418' remove every subfield having a higher grayscale than the peak subfield (including the reset period of the subfield having a grayscale higher than but closest to the peak subfield) regardless of the comparison result of the comparator 426.

As describe above, according to the first exemplary embodiment of the present invention, power consumption is reduced by removing subfields that are not used. In addition, according to the second exemplary embodiment of the present invention, the reset period of a subfield to be removed may be maintained or removed depending on a comparison of previous and current frames, and therefore, flickers may be prevented. Further, according to the third exemplary embodiment of the present invention, when a load of a panel exceeds a threshold value, all periods (including the reset period) in subfields having higher grayscales than the peak subfield are removed and accordingly power consumption may be further enhanced.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims and equivalents thereof.

What is claimed is:

1. A method for processing an image of a plasma display panel that displays gray levels by a combination of brightness weights of a plurality of subfields in a frame, in response to an input video signal, the method comprising:

generating a peak subfield index of a current frame based on a highest grayscale value detected from an image data of the current frame, wherein all subfields of the current frame having an index higher than the peak subfield index are not used in the current frame;

generating a control signal based on a comparison between a peak subfield index of a previous frame and the peak subfield index of the current frame; and removing at least one period of reset, address, and sustain periods of at least one subfield that is not used in the current frame, in response to the control signal and the peak subfield index of the current frame.

2. The method of claim 1, wherein the peak subfield index of the current frame has a higher value as less number of the subfields are not used in the current frame.

3. The method of claim 2, wherein the generating the control signal comprises generating a first control signal when the peak subfield index of the current frame is greater than or equal to the peak subfield index of the previous frame, and generating a second control signal when the peak subfield index of the current frame is less than the peak subfield index of the previous frame.

4. The method of claim 3, wherein the removing the at least one period comprises maintaining the reset period of a subfield having a lowest brightness weight among the at least one subfield, in response to the second control signal.

5. The method of claim 1, wherein the peak subfield index of the previous frame has been delayed by one frame.

6. An apparatus for driving a plasma display panel configured to display gray levels by a combination of brightness weights of a plurality of subfields in a frame, comprising:

a peak detector for generating a peak subfield index of a current frame based on a highest grayscale value detected from an image data of the current frame, wherein all subfields of the current frame having an index higher than the peak subfield index are not used in the current frame;

a delay unit for delaying a peak subfield index of a previous frame by a period of one frame;

a comparator for generating at least one control signal based on a comparison between the peak subfield index of the previous frame supplied from the delay unit and the peak subfield index of the current frame supplied from the peak detector; and a subfield generator and a sustain number generator for removing at least one period of reset, address, and sustain periods of at least one subfield that is not used in the current frame, in response to the control signal and the peak subfield index of the current frame.

7. The apparatus of claim 6, wherein the peak subfield index of the current frame has a higher value as less number of subfields are not used in the current frame.

8. The apparatus of claim 7, wherein the comparator generates a first control signal when the peak subfield index of the current frame is greater than or equal to the peak subfield index of the previous frame, and generates a second control signal when the peak subfield index of the current frame is less than the peak subfield index of the previous frame.

9. The apparatus of claim 8, wherein the subfield generator and sustain number generator maintain the reset period of a subfield having a lowest brightness weight among the at least one subfield, in response to the second control signal.

10. A plasma display panel comprising:

a panel having a plurality of discharge cells for displaying images during frames, each frame comprising a plurality of subfields and each subfield comprising a reset period, an address period and a sustain period;

an address driver for providing data signals for selecting the discharge cells during the address period;

a scan/sustain driver for generating sustain discharges during the sustain period in the discharge cells selected during the address period, thereby displaying the images; and a controller for generating a peak subfield index of a current frame based on a highest grayscale value detected from an image data of the current frame, wherein all subfields of the current frame having an index higher than the peak subfield index are not used in the current frame, for generating a control signal based on a comparison between a peak subfield value of a previous frame and the peak subfield index of the current frame, and for removing at least one of the reset, address and sustain periods of at least one subfield that is not used in the current frame, in response to the control signal and the peak subfield index of the current frame.

11. The plasma display panel of claim 10, wherein the previous frame is a frame that is immediately prior to the current frame.

12. The plasma display panel of claim 10, wherein the control signal is a first control signal when the peak subfield index of the current frame is greater than or equal to the peak subfield index of the previous frame, and the control signal is a second control signal when the peak subfield index of the current frame is less than the peak subfield index of the previous frame.

13. The plasma display panel of claim 12, wherein the reset period of a subfield having a lowest brightness weight among the at least one subfield is maintained in response to the second control signal.

* * * * *